US006843639B2

(12) United States Patent
Schütt

(10) Patent No.: US 6,843,639 B2
(45) Date of Patent: Jan. 18, 2005

(54) BLOWER

(75) Inventor: Jörg Schütt, Waiblingen (DE)

(73) Assignee: Andreas Stihl AG & Co. KG (DE)

( * ) Notice: Subject to any disclaimer, the term of this patent is extended or adjusted under 35 U.S.C. 154(b) by 19 days.

(21) Appl. No.: 10/612,629

(22) Filed: Jul. 2, 2003

(65) Prior Publication Data

US 2004/0005232 A1 Jan. 8, 2004

(30) Foreign Application Priority Data

Jul. 5, 2002 (DE) ..... 102 30 289

(51) Int. Cl.[7] ..... F04D 29/44
(52) U.S. Cl. ..... 415/212.1; 15/416; 15/418
(58) Field of Search ..... 415/1, 203, 204, 415/206, 211.1, 212.1; 15/416, 415.1, 418, 419

(56) References Cited

U.S. PATENT DOCUMENTS 4,413,371 A * 11/1983 Tuggle et al. ..... 15/405
5,931,609 A * 8/1999 Sickles ..... 406/1
6,076,231 A * 6/2000 Bucher ..... 15/405
6,468,053 B2 10/2002 Wölpert
6,526,624 B2 * 3/2003 Miyamoto ..... 15/414

* cited by examiner

*Primary Examiner*—Edward K. Look
*Assistant Examiner*—Dwayne White
(74) *Attorney, Agent, or Firm*—R W Becker & Associates; R W Becker

(57) ABSTRACT

A blower having a discharge tube, which can be secured to a housing, for guiding a stream of air is provided. The air stream flows in a main stream direction in the discharge tube and in a discharge stream direction out of the discharge tube. The discharge stream direction forms an angle of greater than 0° with the main stream direction. The discharge stream direction has a transverse component that extends perpendicular to the main stream direction, which produces a force in the discharge tube perpendicular to the main stream direction. To reduce the transverse force produced in the discharge tube, a partial air stream is branched off out of the discharge tube and flows in a partial stream direction that has a compensation component that is directed opposite to the transverse component.

16 Claims, 5 Drawing Sheets

1
6
4
9
5
2
3
19
18
17
11

BLOWER

BACKGROUND OF THE INVENTION

The present invention relates to a blower having a discharge tube that can be secured to a housing and that serves for guiding a stream of air.

A blower is known from U.S. Pat. No. 6,468,053. Blowers can have differently configured discharge tubes. To clean the edges of paths, discharge tubes expediently have a bent configuration. By changing the direction of the air stream in the discharge tube, a transverse force is produced that must be absorbed by the operator via the handle. In particular, with high-power blowers, great forces are required for this purpose, which can lead to rapid fatigue of the operator.

It is therefore an object of the present invention to provide a blower of the aforementioned general type whereby during operation of such a blower low holding forces are required.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
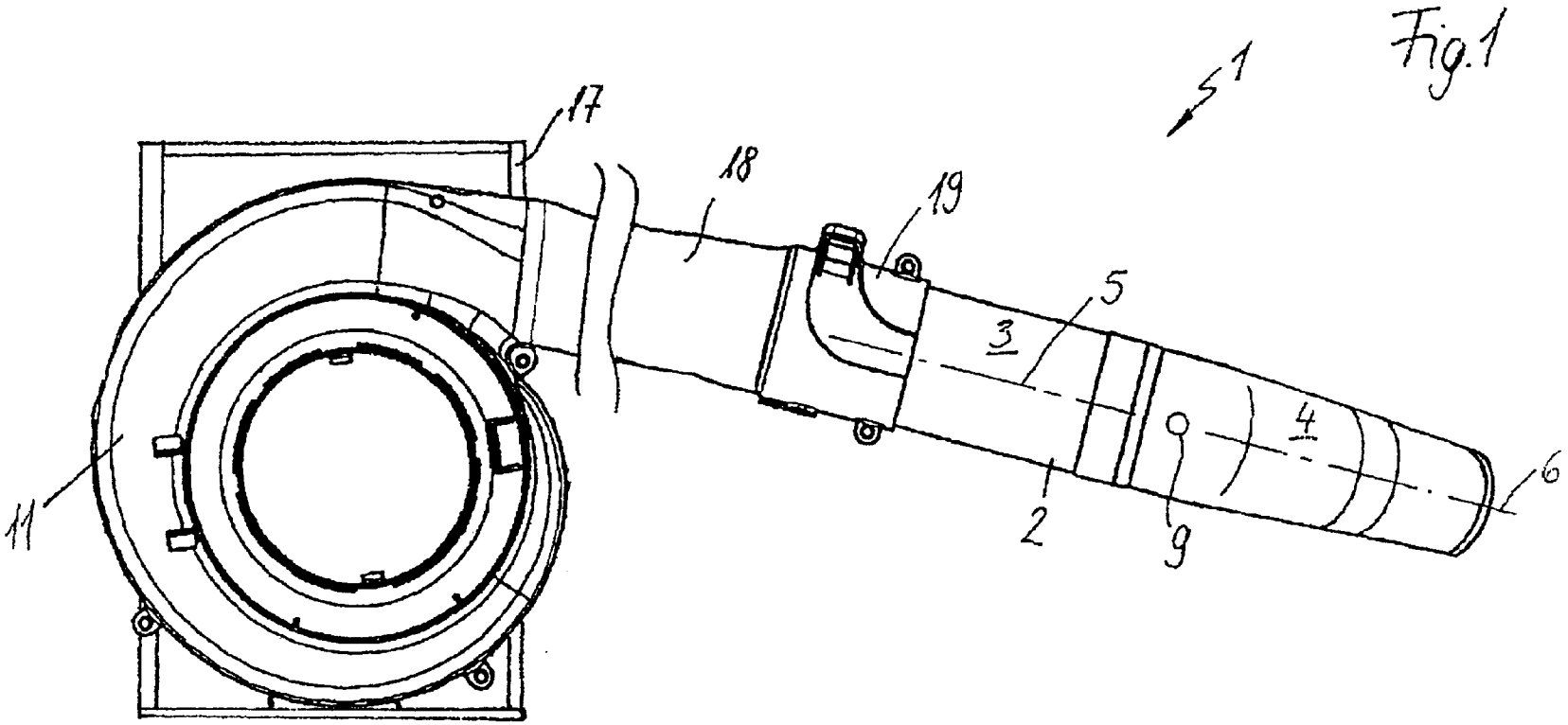
FIG. 1 is a side view onto one exemplary embodiment of an inventive blower.

The blower of the present invention comprises a housing and a discharge tube, which is securable to the housing, for guiding a stream of air, wherein the air stream flows in a main stream direction in the discharge tube and in a discharge stream direction out of the discharge tube, wherein the discharge stream direction forms an angle of greater than 0° with the main stream direction, wherein the discharge stream direction has a transverse component that extends perpendicular to the main stream direction, wherein a partial air stream is branched off from the air stream and out of the discharge tube, and wherein the partial air stream flows in a partial stream direction that has a compensation component that is directed opposite to the transverse component.

The compensation component that is directed opposite to the transverse component produces a force that is directed opposite or counter to the force produced by the angled-off discharge stream direction. The force, which is to be applied by the operator, is thereby reduced or entirely eliminated.

The angle between the partial stream direction and the main stream direction is expediently greater than the angle between the main stream direction and the discharge stream direction. In particular, the angle between the partial stream direction and the main stream direction is approximately 90°. The compensation component thus extends in the partial stream direction.

The partial air stream is utilized entirely for producing the counter or opposing force. The discharge tube advantageously has an opening through which flows or issues the partial air stream. The opening can be manufactured in a straightforward manner. It is also possible to provide an opening in an existing discharge tube at a later stage. In order to only slightly adversely affect the blower effect, it is provided that the flow cross-section of the opening be smaller than that of the flow cross-section through which the air stream flows out of the discharge tube in the discharge stream direction. To achieve a greater velocity in the partial air stream, it is provided that the opening have a nozzle-like configuration. The greater velocity leads to a larger force that counteracts the force produced by the transverse component.

The partial steam direction of the partial air stream can advantageously be varied. In addition, or alternatively, the volume of the partial air stream can be varied. The magnitude of the force produced by the compensation component is thereby also variable. In particular by varying the volume of the partial air stream, the operator, depending upon the use, can set a lower operator force that is to be applied or a greater blowing effect, in other words, a larger volume stream in the discharge flow direction. The partial air stream can expediently be cut off. As a result, the blower can also be used with a non-reduced blowing effect and non-reduced high holding forces.

A slide mechanism is expediently provided for controlling the volume of the partial air stream. The slide mechanism expediently acts upon the flow cross-section of the opening. By shifting the slide mechanism, the volume of the partial air stream can thus be varied and shut-off. At a maximum opening, the transverse force is advantageously entirely compensated for.

To adapt the blower to different applications, it is provided that the angle between the discharge stream direction and the main stream direction be variable. In particular, the partial stream direction and/or the volume of the partial air stream is variable as a function of the angle between the discharge stream direction and the main stream direction. The transverse component of the discharge stream direction is a function of the angle between the discharge stream direction and the main stream direction. At an angle of about 0°, the transverse component is 0. As the angle increases, the transverse component increases in a sinusoidal manner. In order in different deflection angles to respectively achieve an optimum compensation component, the latter is similarly variable. In particular, the discharge tube is provided with a pivot joint that includes a first joint portion in which the air stream flows in the main stream direction, and a second joint portion in which the air stream flows in the discharge stream direction. The first and second joint portions can be rotated relative to one another about an axis of rotation that extends perpendicular to the main stream direction and to the discharge stream direction. In this way, the angle between the main stream direction and the discharge stream direction can be varied in a straightforward manner. Advantageously, in at least one angular range of the position of the joint portions relative to one another, the flow cross-section of the partial stream can be varied as a function of the position of the joint portions relative to one another.

In order to achieve an adequate volume of the partial air stream, it is provided that the partial air stream be branched off at least partially within the main cross-section section of the air stream through the discharge tube. At the edge of the discharge tube, the flow velocity that is to be formed is low, so that when the partial air stream is branched off, for example by the wall of the discharge tube, the velocity of the partial air stream can be low, so that the force produced is similarly only very low.

Further specific features of the present invention will be described in detail subsequently.

DESCRIPTION OF PREFERRED EMBODIMENTS

Referring now to the drawings in detail, FIG. 1 shows a blower 1 having a housing 11 to which a blower or discharge tube 2 can be secured via a discharge connector 19. The blower 1 is generally carried on the back via a pack 17, which is merely indicated in FIG. 1. The discharge tube 2 has a flexible portion 18 via which the air stream is guided about the body of an operator. Generally disposed on the discharge tube 2 is a handle, which is not illustrated in FIG. 1. An engine, especially an internal combustion engine, is generally disposed in the housing 11. The engine drives a fan that produces an air stream through the discharge tube 2. The discharge tube 2 is provided with a main portion 3 having a longitudinal axis 5, and a discharge portion 4 that extends at an angle to the main portion; the discharge portion 4 has a longitudinal axis 6. The angle between the longitudinal axes 5 and 6 of the main portion 3 and of the discharge portion 4 respectively is less than 180°. On that end of the main portion 3 that faces the discharge portion 4 an opening 9 is provided in the discharge tube 2 through which issues a partial air stream of the air stream that is flowing through the main portion 3 of the discharge tube 2. The partial stream direction in which the partial air stream issues from or flows out of the opening 9 is rotated or shifted relative to the main stream direction in which the air stream flows in the main portion 3, whereby the partial stream direction and the discharge stream direction, in which the air stream flows in the discharge portion 4, are rotated in opposite directions relative to the main stream direction. The partial air stream 9 thus produces a force counter to the force produced by the transverse component of the discharge stream direction.

Figure 2:
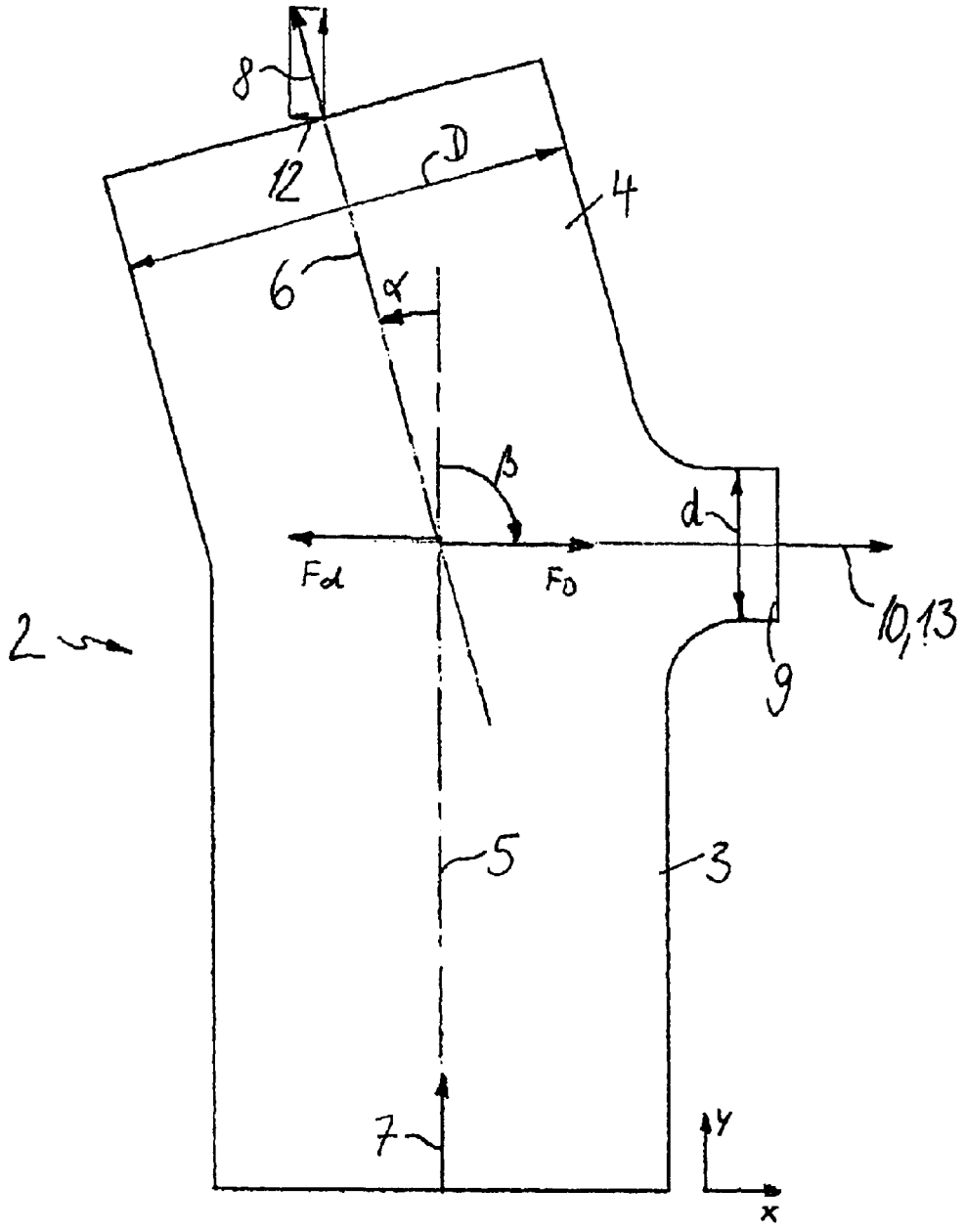
FIG. 2 is a schematic illustration of the flow directions in a blower.

FIG. 2 schematically illustrates a discharge tube 2 having a main portion 3, a discharge portion 4, as well as an opening 9. The flow cross-sections in the main portion 3, the discharge portion 4 and the opening 9 are circular. The discharge portion 4 has a diameter D and the opening has a diameter d. However, other cross-sectional shapes can also be expedient. In the main portion 3, the air stream flows in the main flow direction 7, which extends parallel to the longitudinal axis 5 of the main portion 3. In the discharge portion 4, a discharge air stream flows in the discharge stream direction 8, which extends parallel to the longitudinal axis 6 of the discharge portion 4 and is rotated by an angle $\alpha$ relative to the main stream direction 7, whereby the angle $\alpha$ is greater than 0°. In the region where the air stream changes direction, an opening 9 is disposed in the discharge tube 2 through which a partial stream flows along the partial stream direction 10. The partial stream direction 10 is rotated relative to the main stream direction 7 by an angle $\beta$ that in the embodiment illustrated in FIG. 2 is approximately 90°. However, other angles $\beta$ can also be expedient. The discharge stream direction 8 has a transverse component 12 that is perpendicular to the main stream direction 7 and produces a force $F_D$ perpendicular to the main stream direction 7. The partial stream direction 10 has a compensation component 13 that with the right-angled deflection of the partial stream illustrated in FIG. 2 corresponds to the partial stream direction 10 and is directed opposite to the transverse component 12. The partial air stream that flows in the direction of the compensation component 13 produces a counter force $F_d$ to the force $F_D$ produced by the discharge stream.

The resulting force F is the force that is exerted upon the discharge tube 2 in the region of the deflection. This force must be applied by the operator, whereby the force acting upon the handle can be a multiple of the resulting force F due to the lever effect. For the resulting force F there results the equation $F=F_D-F_d=p\cdot v_D^2\cdot A_D\cdot\sin\alpha-p\cdot v_d^2\cdot A_d\cdot\sin\beta$, where $\rho$, is the density of the flowing air, $v_D$ is the flow velocity in the discharge stream direction 8, $A_D$ is the flow cross-section in the discharge portion 4, $v_d$ is the flow velocity in the partial stream direction 10, and $A_d$ is the flow cross-section in the opening 9. At an angle $\beta$ of 90°, and under the assumption that the flow velocity $v_D$ in the discharge stream direction 8 corresponds to the low velocity $v_d$ in the partial stream direction 10, there results for the resulting force F with the flow velocity v $F=p\cdot v^2\cdot(A_D\cdot\sin\alpha-A_d)$. The base force $F_B$ that results when the partial air stream is 0 is $F_B=p\cdot v^2\cdot A_R\cdot\sin\alpha$, whereby $A_R$ is the flow cross-section in the main portion 3, which corresponds to the flow cross-section in the discharge portion 4, and the velocity v is the flow velocity that is constant in the overall discharge tube 2.

Figure 3:
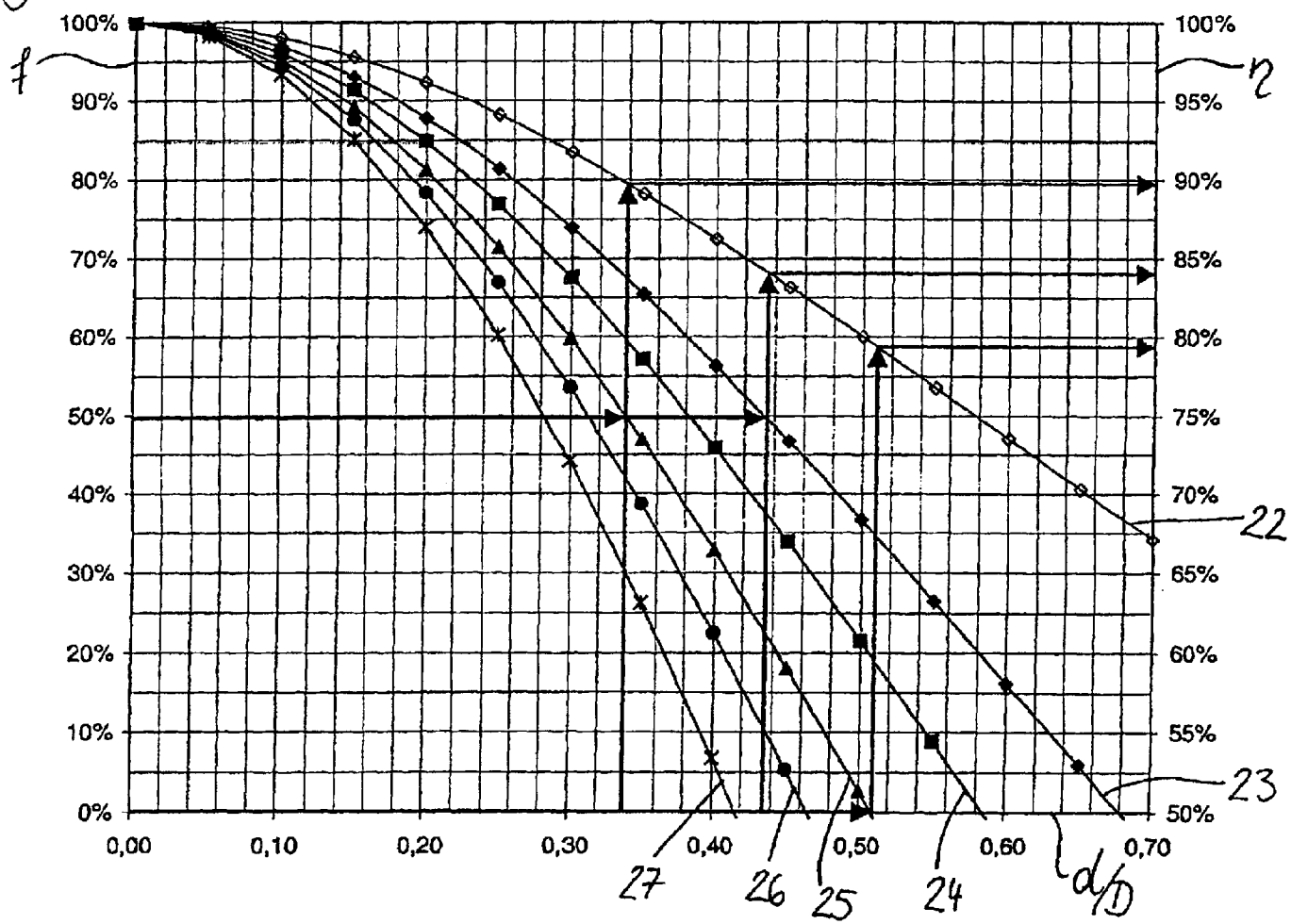
FIG. 3 is a graph in which the magnitude of the counter force produced, and the output or efficiency, are plotted against the ratio of the diameters of the partial air stream and the discharge air stream.

In FIG. 3, the remaining force component f, which is defined as $f=1-F/F_B$, as well as the output or efficiency $\eta$, which defines the ratio of the volume stream in the discharge stream direction 8 to the volume stream through the opening 9, are plotted against the diameter ratio d/D of the diameter d of the flow cross-section $A_d$ in the opening 9 to the diameter D of the flow cross-section $A_D$ in the discharge portion 4. In this connection, circular flow cross-sections $A_d$, $A_D$ are presumed. With cross-sections that deviate from a circular shape, a corresponding graph results if the ratio of the square roots of the flow cross-sections $A_d$, $A_D$ are plotted. In this connection, the curve 22 designates the output $\eta$ for various diameter ratios d/D, and the curves 23, 24, 25, 26, 27 designate the remaining force component f at different angles $\alpha$ between the main stream direction 7 and the discharge stream direction 8. The curve 23 represents the remaining force component f at an angle $\alpha$ of 27.5°, the curve 24 represents the force component at an angle $\alpha$ of 20°, the curve 25 represents the force component at an angle $\alpha$ of 15°, the curve 26 represents the force component at an angle $\alpha$ of 12.5°, and the curve 27 represents the force component at an angle $\alpha$ of 10°. A diameter ratio d/D of 0 means that no partial stream is branched off. The remaining force component f is thus 100%. The output $\eta$ is also 100%, since the entire volume stream is discharged in the discharge stream direction 8.

As the diameter ratio d/D increases, in other words as the size of the opening 9 increases, not only the remaining force component f but also the output $\eta$ decrease. In this connection, the remaining force component f drops more rapidly the smaller the angle $\alpha$ is. Thus, at an angle $\alpha$ of 10° (Curve 27) there results a remaining force component f of 0% already at a diameter ratio d/D of 0.42. At an angle of 27.5° (Curve 23), a diameter ratio d/D of about 0.68 is necessary for a remaining force component f, i.e. the diameter d of the opening 9 is approximately 68% of the diameter D in the discharge portion 4. A number of values are indicated in FIG. 3 as examples. In order, for example, to realize a remaining force component f of 50%, at an angle $\alpha$ of 27.5° (Curve 23) the diameter ratio of d/D must be about 0.435. At this diameter ratio, an output $\eta$ of about 84% results. For the same remaining force component f, at an angle $\alpha$ of 15° (Curve 25) a diameter ratio d/D of about 0.34 suffices. At this diameter ratio, the output $\eta$ is about 90°. At this angle $\alpha$, a diameter ratio of d/D of about 0.51 can achieve a remaining force component f of 0%. The output $\eta$ is then right at 80%.

Figure 4:
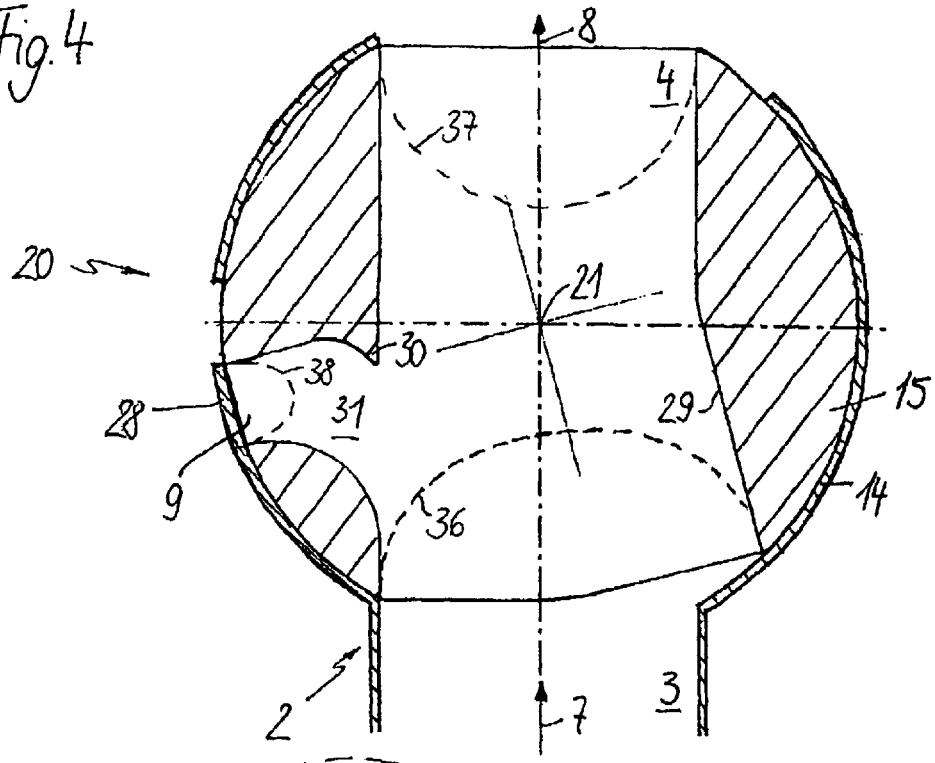
FIGS. 4 & 5 are cross-sectional views of a pivot joint of a discharge tube in various positions.
Figure 5:
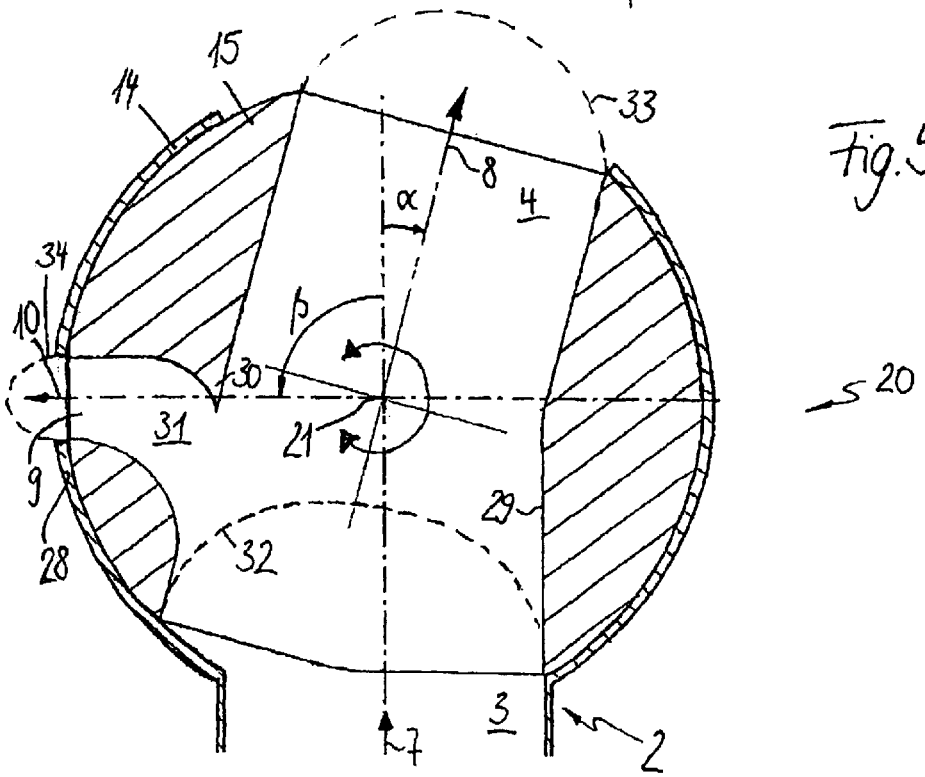

An embodiment of the invention is illustrated in FIGS. 4 and 5. The discharge tube 2 includes a pivot joint 20, which is formed from a first joint portion 14 and a second joint portion 15. The first joint portion 14 is monolithically formed with the main portion 3, and the second joint portion 15 is monolithically formed with the discharge portion 4. The joint portions 14,15 can have a spherical or cylindrical configuration, and are rotatable relative to one another about the axis of rotation 21. In this connection, the axis of rotation 21 is disposed perpendicular to the main stream direction 7 and to the discharge stream direction 8. In this position illustrated in FIG. 4, the main stream direction 7 and the discharge stream direction 8 extend parallel to one another. The direction of the air stream is not changed in the discharge tube 2. The opening 9, which is formed in the second joint portion 15, is completely closed off by the covering 28, which forms a portion of the first joint portion 14. Thus, no partial air stream is branched off out of the discharge tube 2.

In the position illustrated in FIG. 5, the joint portions 14,15 are rotated relative to one another about an angle $\alpha$. The discharge stream direction 8 is thus rotated by the angle $\alpha$ relative to the main stream direction 7. The covering 28 releases the opening 9 in the second joint portion 15, so that a partial air stream can issue through the opening 9 in the partial stream direction 10. The partial stream direction 10 is rotated relative to the main stream direction 7 by an angle $\beta$ of about 90°. The positions of the joint portions 14, 15 relative to one another in FIGS. 4 and 5 represent the extreme positions of the pivot joint 20. Any number of other deflections can be established between these two positions. At small angles $\alpha$, the opening 9 is still largely closed off by the covering 28. The force produced by the partial air stream is thus small. Due to the low angle $\alpha$, only a small force is produced by the change in direction of the air stream, so that a lower flow cross-section of the opening 9 is adequate. At the same time, there results a good output $\eta$.

The wall portion 29 of the discharge tube 2 that is disposed across from the opening 9 is inclined relative to the discharge stream direction 8 by an angle that expediently corresponds to the maximum angle of rotation of the two joint portions 14,15 relative to one another illustrated in FIG. 5. This ensures that as the stream flows into the second joint portion 15 the flow is not obstructed by the wall portion 29. In order to achieve a good discharge of the partial air stream, the feed to the opening out of the main portion 3 is embodied as a channel 31, which for avoiding flow losses has a rounded configuration.

In FIG. 4, the cross-sections are illustrated by dashed lines. In this connection, the line 36 indicates the cross-section in the main portion 3, the line 37 indicates the cross-section in the discharge portion 4, and the line 38 indicates the cross-section in the opening 9. The cross-sections are approximately circular or elliptical, although other cross-sectional shapes can also be advantageous.

In FIG. 5, the resulting flow velocity profiles are illustrated by dashed lines. In this connection, the line 32 designates the profile in the main portion 3, the line 33 designates the flow velocity profile in the discharge portion 4, and the line 34 designates the flow velocity profile in the region of the opening 9. In the edge portion of the flow, low velocities respectively prevail. In order when the opening 9 is opened to achieve an adequate partial air stream through the opening 9, an edge 30 is therefore disposed at that side of the channel 31 that faces the discharge portion 4. The edge 30 advantageously extends into the flow cross-section in the main portion 3. The partial air stream is thus branched off within the flow cross-section of the air stream, especially within the flow cross-section AR in the main portion 3. This ensures an adequate partial air stream.

Figure 6:
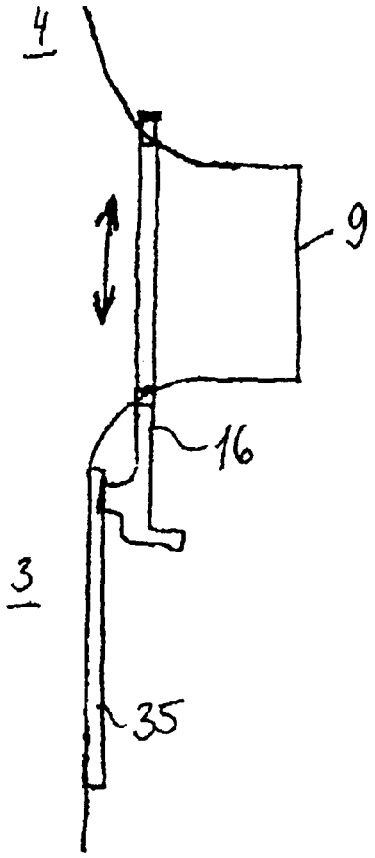
FIGS. 6 & 7 are schematic side views of a slide mechanism for a discharge tube.
Figure 7:
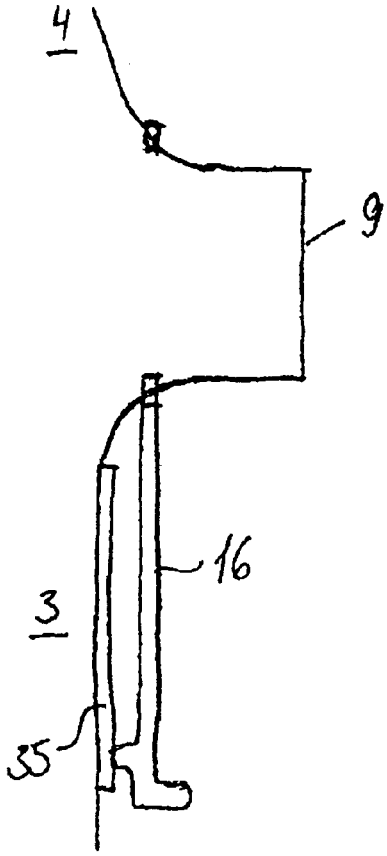

FIGS. 6 and 7 schematically illustrate a slide mechanism 16 via which the flow cross-section $A_d$ of the opening 9 can be altered. As illustrated in FIG. 6, the opening 9 can expediently be completely closed off by the slide mechanism 16, thereby cutting-off the partial air stream. The slide mechanism 16 is guided in a guide means 35 parallel to the main portion 3. The guide means 35 can, for example, be embodied as a rail. The slide mechanism 16 can be manually actuatable. However, it can also be expedient to provide a draw or traction mechanism, especially with a retraction spring, for the actuation of the slide mechanism 16.

The discharge tube 2 is advantageously formed from a discharge portion 4 and a main portion 3. However, instead of the discharge portion 4, the air stream can also change its direction merely in the discharge tube 2, thereby resulting in a discharge stream direction that is rotated relative to the main stream direction. A discharge portion is then not necessary.

The present invention is particularly advantageous with blowers that are carried on the back of an operator; however, the present invention can also be expediently utilized with manually-guided blowers.

The specification incorporates by reference the disclosure of German priority document DE 102 30 289.8 filed 5 Jul. 2002.

The present invention is, of course, in no way restricted to the specific disclosure of the specification and drawings, but also encompasses any modifications within the scope of the appended claims.

I claim:

1. A blower, comprising:

a housing; and a discharge tube, securable to said housing, for guiding a stream of air, wherein the air stream flows in a main stream direction in said discharge tube and in a discharge stream direction out of said discharge tube, wherein said discharge stream direction forms an angle of greater than 0° with the main stream direction, wherein said discharge stream direction has a transverse component that extends perpendicular to the main stream direction, wherein a partial air stream is adapted to be branched off from the main stream and out of said discharge tube, and wherein said partial air stream flows in a partial stream direction that has a compensation component that is directed opposite to said transverse component.

2. A blower according to claim 1, wherein an angle between said partial stream direction and said main stream direction is greater than the angle between said main stream direction and said discharge stream direction.

3. A blower according to claim 1, wherein an angle between the partial stream direction and the main stream direction is approximately 90°.

4. A blower according to claim 1, wherein said partial stream direction of said partial air stream is variable.

5. A blower according to claim 1, wherein means are provided for shutting off the partial air stream.

6. A blower according to claim 1, wherein said partial air stream is branched off at least partially within a flow cross-section of the air stream through the discharge tube.

7. A blower according to claim 1, wherein said discharge tube has an opening 9 through which said partial air stream issues.

8. A blower according to claim 7, wherein a flow cross-section of said opening is smaller than a flow-cross section through which the air stream flows out of said discharge tube in said discharge stream direction.

9. A blower according to claim 7, wherein said opening has a nozzle-like configuration.

10. A blower according to claim 1, wherein a volume of said partial air stream is variable.

11. A blower according to claim 10, wherein a slide mechanism is provided for controlling a volume of said partial air stream.

12. A blower according to claim 11, wherein said slide mechanism acts upon a flow cross-section of an opening in said discharge tube for said partial air stream.

13. A blower according to claim 1, wherein said angle between said discharge stream direction and said main stream direction is variable.

14. A blower according to claim 13, wherein at least one of said partial stream direction and a volume of said partial air stream is variable as a function of said angle between said discharge stream direction and said main stream direction.

15. A blower according to claim 13, wherein said discharge tube is provided with a pivot joint that includes a first joint portion, in which the air stream flows in said main stream direction, and a second joint portion, in which the air stream flows in said discharge stream direction, wherein said first joint portion and said second joint portion are rotatable relative to one another about an axis of rotation that extends perpendicular to said main stream direction and said discharge stream direction.

16. A blower according to claim 15, wherein at least in one angular range of a position of said first and second joint portions relative to one another, a flow cross-section of said partial air stream is varied as a function of the position of the first and second joint portions relative to one another.

* * * * *